US006393614B1

(12) United States Patent
Eichelbaum

(10) Patent No.: US 6,393,614 B1
(45) Date of Patent: May 28, 2002

(54) DISPOSABLE GLOVE WITH POCKETS

(76) Inventor: Lauren M. Eichelbaum, 400 Second Ave. 24-B, New York, NY (US) 10010

( * ) Notice: Subject to any disclaimer, the term of this patent is extended or adjusted under 35 U.S.C. 154(b) by 0 days.

(21) Appl. No.: 09/939,680

(22) Filed: Aug. 28, 2001

Related U.S. Application Data

(60) Provisional application No. 60/228,401, filed on Aug. 29, 2000.

(51) Int. Cl.[7] ..... A41D 19/00

(52) U.S. Cl. ..... 2/160; 2/158; 2/159; 2/161.7

(58) Field of Search ..... 2/16, 20, 158, 2/159, 160, 161.6, 161.7, 161.8, 163, 168; 206/438, 440, 282, 205, 823; 294/1.3, 1.5, 25; 604/358, 393, 904; 15/227

(56) References Cited

U.S. PATENT DOCUMENTS 2,265,329 A * 12/1941 Wachs ..... 15/227
3,372,799 A * 3/1968 Abildgaard ..... 123/352
4,677,697 A * 7/1987 Hayes ..... 2/159
4,788,733 A * 12/1988 Lerner ..... 15/104.94
4,902,283 A * 2/1990 Rojko et al. ..... 15/227
4,937,881 A * 7/1990 Heise ..... 15/227
5,020,159 A * 6/1991 Hellickson ..... 2/158
5,406,649 A * 4/1995 Bolembach ..... 2/158
5,438,708 A * 8/1995 Jacovitz ..... 15/227
5,740,554 A * 4/1998 Reed ..... 2/158
5,987,645 A * 11/1999 Teaster ..... 2/159
5,988,386 A * 11/1999 Morrow ..... 206/440
6,233,742 B1 * 5/2001 Yungkurth ..... 2/160

* cited by examiner

*Primary Examiner*—John J. Calvert
*Assistant Examiner*—Gary L. Welch
(74) *Attorney, Agent, or Firm*—Rodger H. Flagg

(57) ABSTRACT

A biodegradable, disposable glove carries a disposable sanitary item in a pocket thereof. The glove includes a glove body, an open end of the glove body having a ziplock securement means, which is operable only when the glove 100 is turned inside out. In use, the glove can be used for dispensing an unused disposable sanitary item and for retrieving the sanitary item for disposal after use. The glove is preferably loose-fitting. In use, the glove is placed over the hand of a user, and the user can then retrieve the used sanitary item such as a tampon or sanitary napkin. Once the tampon or sanitary napkin has been retrieved, the user can manipulate it into a pocket in the glove using only the fingers and thumb of the gloved hand. The pocket includes a ziplock sealing edge feature, which permits sealing-in of the biodegradable or disposable sanitary item into the pocket, so that no fluid leakage occurs during removal and subsequent disposal of the biodegradable, disposable glove. The glove is adaptable for both left and right hand use.

20 Claims, 3 Drawing Sheets

DISPOSABLE GLOVE WITH POCKETS

This utility patent application claims priority of provisional patent application No. 60/228401 filed Aug. 29, 2000, and this provisional patent application is hereby incorporated by reference herein.

FIELD OF THE INVENTION

The present invention relates to disposable articles and to biodegradable, disposable gloves for use therewith which are suitable for single use applications. More particularly, the invention relates to a disposable glove with-pockets, and a sealing feature for retrieving and disposing of used tampons and sanitary napkins.

BACKGROUND OF THE INVENTION

Sanitary napkins, tampons, and the like serve a well known and useful purpose. At times they are used while traveling, or when disposal after use is not convenient. Some user's flush the sanitary napkins or tampons down toilets, where they at times clog the toilet. Disposing of used sanitary napkins or tampons in trash containers, or waste towel receptacles is not sanitary and at times presents an odor problem, as well as attracting flies and other insects. This results in an unsatisfactory and unsanitary disposal process. The janitorial staff are thus exposed to infectious diseases from transmission of infected blood from used tampons, which poses serious health risks.

Disposable gloves and mittens are known in the art. Biodegradable gloves and mittens are also known in the art. A number of such devices are discussed hereunder.

U.S. Pat. No. 5,740,554 to Reed teaches a biodegradable mitten for use during disposal of a tampon. After use, the mitten can be inverted, sealed, and thrown away.

U.S. Pat. No. 5,988,386 to Morrow teaches a mitt used as a disposable bag. It includes a closure means.

U.S. Pat. No. 4,937,881 to Heise teaches the use of disposable plastic gloves, which after use, are turned inside out. They are then closed at the top with a closure means.

U.S. Pat. No. 5,438,708 to Jacovitz teaches a biodegradable glove, which after use, may be inverted and the ends tied to keep the glove/bag closed.

U.S. Pat. No. 2,265,329 to Wachs teaches a mitt with a pocket in the middle.

U.S. Pat. No. 4,677,697 to Hayes teaches a disposable plastic glove which may be inverted. Then, a closure is secured at the end of the glove.

U.S. Pat. No. 3,372,799 to Abilgaard teaches rubber gloves which are inverted after use. They are then closed with a seal.

U.S. Pat. No. 4,788,733 to Lerner teaches a disposable glove, which is inverted after use. Then, the ends are closed by a string.

U.S. Pat. No. 4,902,283 to Rojko teaches a plastic glove which is inverted after use. Then, the ends are tied together to close it.

What is needed is an easy, quick and sanitary way of retrieving, storing and disposing of used sanitary napkins, tampons, and the like.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a biodegradable, disposable glove, which has pockets therein for containing or dispensing of used sanitary napkins, tampons, and the like.

More particularly, the device according to the present invention includes a biodegradable, disposable glove or mitten, which is used for disposal of an item such as a tampon or sanitary napkin. The biodegradable, disposable glove or mitten, according to the present invention, includes a first pocket in the palm of the glove or mitten, and a second pocket located on the back side of the glove or mitten, enabling the glove or mitten to be worn on either hand. The first and second pockets provide a means for conveniently storing an unused sanitary item prior to use, and for receiving a used sanitary item for sanitary disposal thereof.

Additional pockets are provided upon or adjacent to the first and second pockets for storing other sanitary objects.

Side loops are also provided for storing at least one tampon prior to use.

Other objects and advantages of the present invention will be more readily apparent from the following detailed description when read in conjunction with the accompanying drawings.

DETAILED DESCRIPTION OF THE INVENTION

Figure 1:
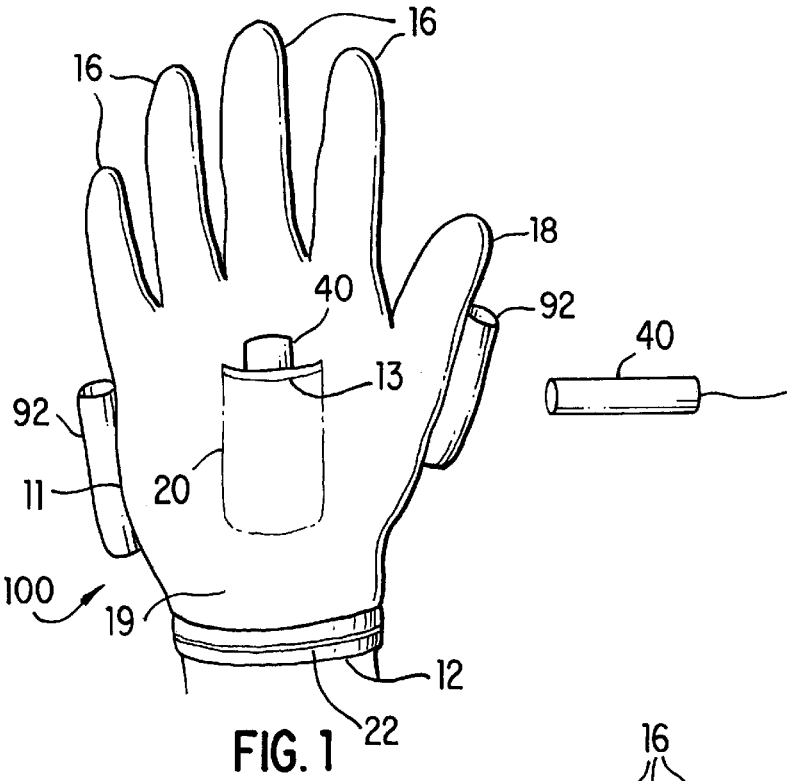
FIG. 1 is an elevational view of a biodegradable, disposable glove for carrying an unused biodegradable or disposable sanitary item in a first or second pocket thereof, according to the present invention.

A disposable glove 100 is shown in FIG. 1 for carrying a sanitary item 40, such as a sanitary napkin 70 or tampon 74, in a first pocket 20 or a second pocket 30. The disposable glove is preferably made of a thin, flexible, biodegradable, opaque plastic material.

The first pocket is located on a palm portion 19 of the biodegradable, disposable glove 100, when worn on the right hand. The second pocket is located on the back side of the disposable glove 100, which becomes the palm side 19 when worn on the left hand. The biodegradable, disposable glove 100 includes a glove body 11 having an open end 12, with adjoining finger portions 16 and a thumb portion 18. Preferably, the disposable glove 100 has a ziplock type releasable closure 13 located adjacent to the open end 12 of the glove 100. The ziplock type releasable closure 13 is operable only when the biodegradable, disposable glove 100 is turned inside out.

In use, the biodegradable, disposable glove 100 includes a first pocket 20 located on the palm side of the glove, which can be used for storing an unused biodegradable or disposable sanitary item 40 until needed, and for retrieving and storing a used sanitary item 40 in preparation for disposal. A second pocket 30 is located on the back hand side of the glove, enabling the glove to be worn on either the right hand or the left hand. This provides significant savings, as one glove fits all, including left and right hand user's, which reduces tooling costs, shipping, inventory and storage costs, as well as reducing the shelf space required to display the product for sale.

The biodegradable, disposable glove 100 is preferably loose fitting, rather than tight or snug. The biodegradable, disposable glove 100 is placed over either the right hand or the left hand of a user, and the user can then position a sanitary item 40, such as a tampon, where needed, and then later retrieve the tampon after use without danger of direct contact with the used sanitary item 40.

Conveniently, the biodegradable, disposable glove 100 protects the user from direct physical contact with the sanitary item 40. This avoids inadvertently soiling the user's hands during the application or removal of the sanitary item 40 from the first pocket 20 or the second pocket 30.

For example, a new, unused sanitary item 40 may be placed in the first pocket 20 or the second pocket 30 prior to use, as a convenient way to transport a single unused sanitary item 40. After use, the soiled sanitary item 40 is removed and replaced in the first pocket 20 or second pocket 30 of the disposable glove 100, without direct contact with the user's hand. Once the used sanitary item 40 is placed in the first pocket 20 or second pocket 30, the glove body 11 may be rolled up around the biodegradable or disposable sanitary item 40 to contain the sanitary item 40 within the inverted, disposable glove 100.

The user can manipulate the used sanitary item into the first pocket 20 or the second pocket 30 located adjacent to the palm area of the glove body 10, using only the finger portion 16 and thumb portion 18 of the gloved hand. The first pocket 20 and the second pocket 30, in a preferred embodiment, includes an optional pocket sealing closure 22. This permits sealing in of the sanitary item 40 into the first pocket 20 or second pocket 30 so that no fluid leakage occurs during removal and disposal of both the disposable glove 100, and the used sanitary item 40.

Figure 2:
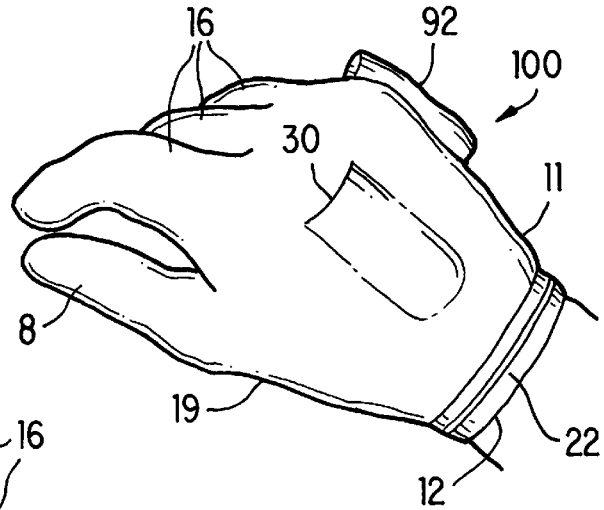
FIG. 2 is an elevational view of a biodegradable, disposable: glove for retrieving a sanitary item, according to the present invention.

FIG. 2 is an elevational view of a biodegradable, disposable glove 100 in use during the retrieval of a used disposable sanitary item 40. The ziplock type releasable sealing closure 13 of the glove body 11 is positioned adjacent to the open end 12 of the glove body 11 in proximity to the wrist of the user. The disposable glove 100 protects the user's hand during retrieval and disposal of the used sanitary item 40.

Figure 3:
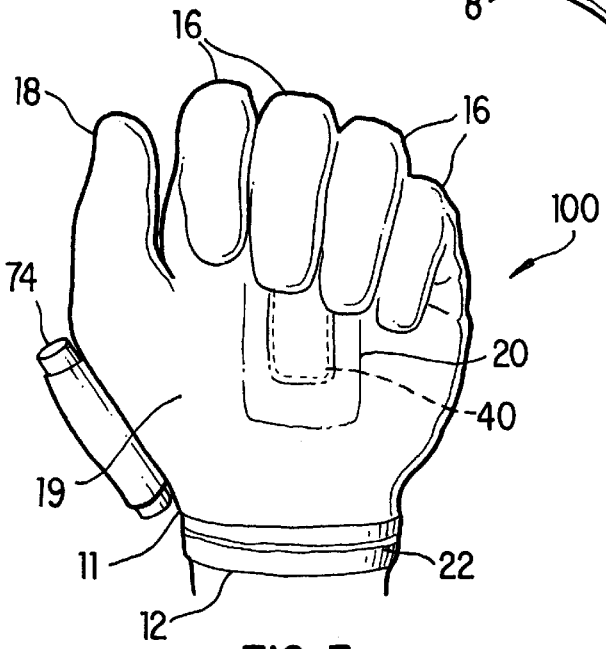
FIG. 3 is an elevational view of a biodegradable, disposable glove for storing a used disposable sanitary item in a first or second pocket of the glove, prior to disposal.

As seen in FIG. 3, the fingers of a user within the disposable glove 100 are folded over, while inserting the used sanitary item 40 into one of the first pocket 20 and the second pocket of the biodegradable, disposable glove 100. This can be done without the aid of the user's ungloved hand, while the glove is installed on either the left hand or the right hand. Thus, the sanitary item 40 is safely stored in one of the first pocket 20 or second pocket 30 in preparation for sanitary disposal.

Figure 4:
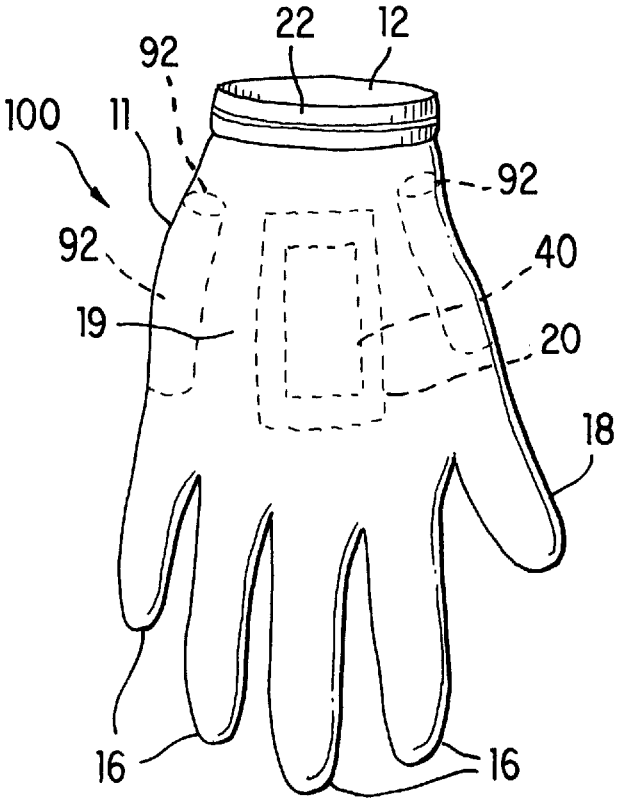
FIG. 4 is an elevational view of a biodegradable, disposable glove in an inverted, inside-out condition, after removal of the glove from the user's hand, showing the storage of the disposable sanitary item within a pocket thereof, according to the present invention.
Figure 6:
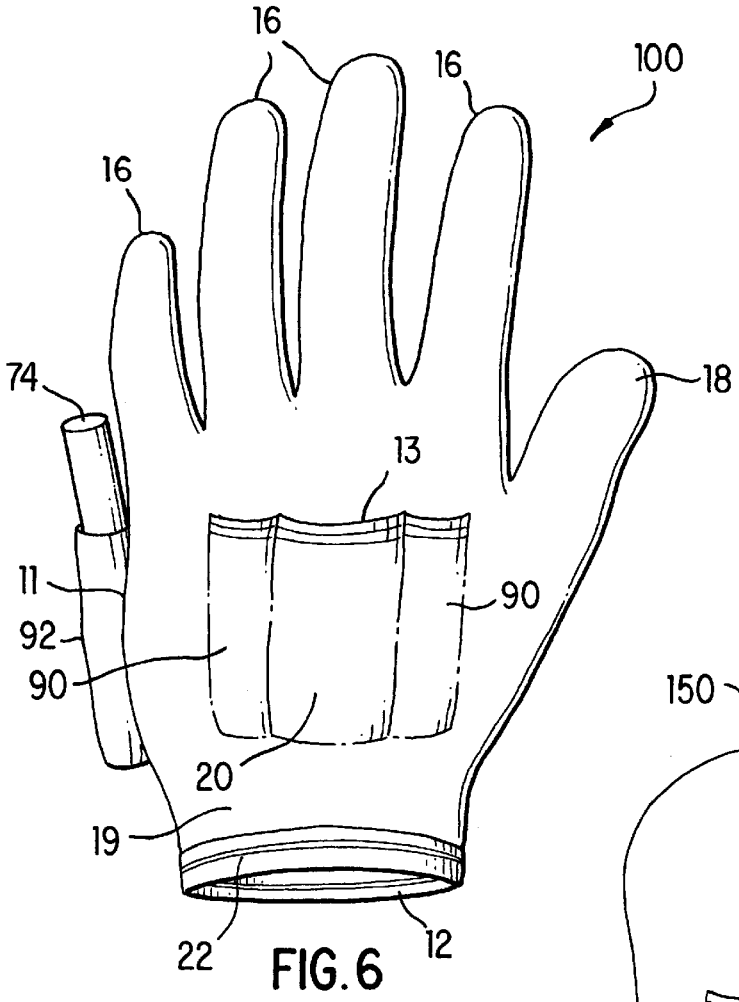
FIG. 6 is an elevational view of another embodiment of a biodegradable, disposable glove having a plurality of additional pockets for carrying related disposable items on a user's right hand.

After insertion of the used sanitary item 40 within one of the first pocket 20 or the second pocket 30, the biodegradable, disposable glove 100 is inverted over the used sanitary item 40 as shown in FIG. 4. The biodegradable, disposable glove 100 is now in an inverted, inside-out condition, ready for sealing the used sanitary item 40 with the ziplock type releasable sealing closure 22 located adjacent to the open end 12 of the disposable glove 100. This may be accomplished without requiring any direct contact between the user's hands and the used sanitary item 40. Thus, the used sanitary item 40 is sealed within the inverted the glove body 11. The glove body 11, with the used sanitary item 40 sealed within, can then be disposed of in a suitable waste receptacle (not shown). Fluids retained by the used sanitary item 40 will not leak out of the disposable glove 100 during disposal, and odors are substantially trapped within the inverted glove body 11.

Because the disposable glove 100 is biodegradable, the disposable glove 100 material will degrade over a period of months in a landfill, eliminating long term disposal problems encountered with non-biodegradable gloves, which may take many years to degrade or otherwise decompose.

Figure 5:
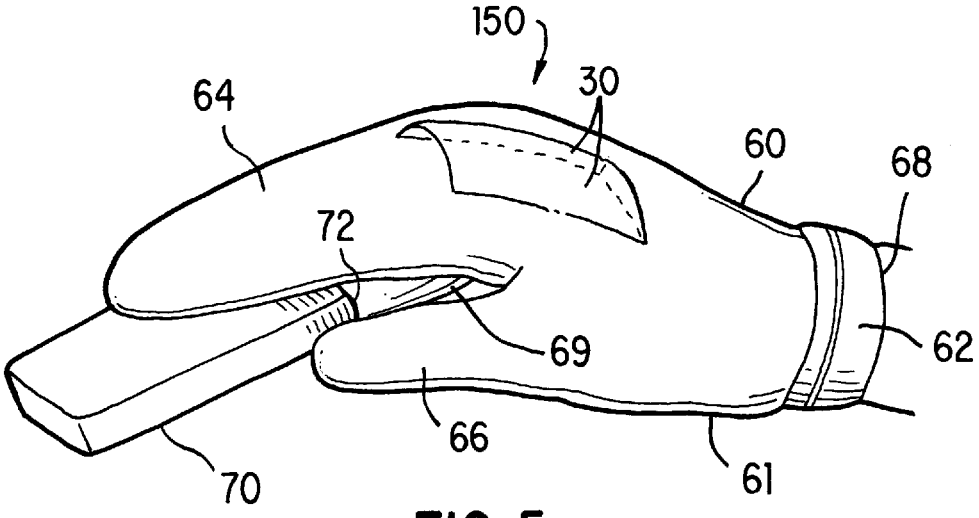
FIG. 5 is an elevational view of a biodegradable, disposable mitten used for retrieving a disposable sanitary item, according to the present invention.
Figure 7:
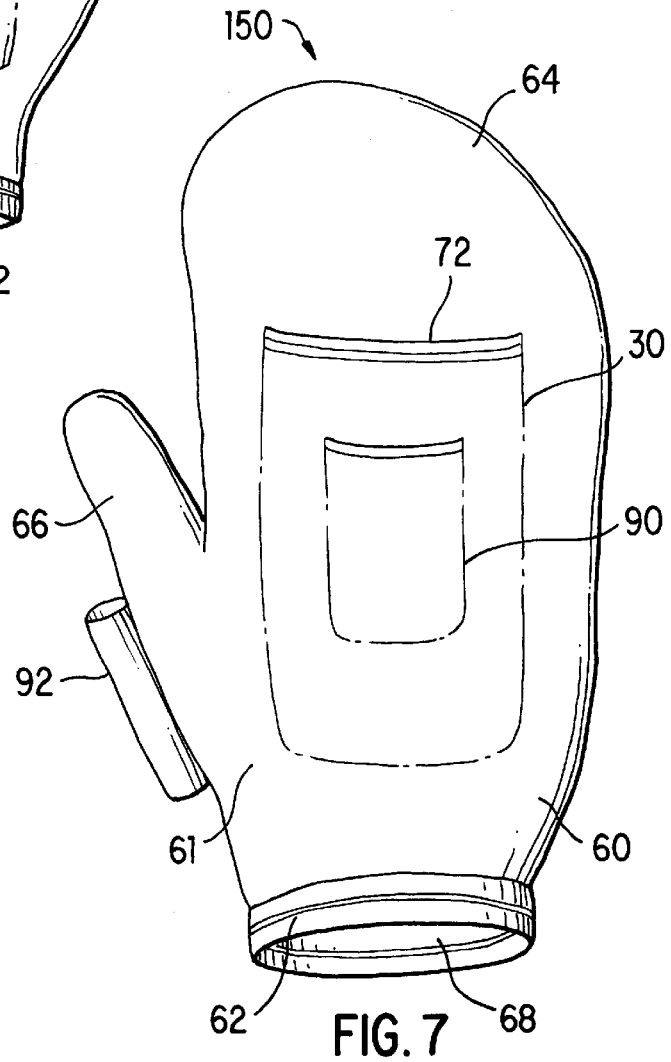
FIG. 7 is an elevational view of an embodiment of a disposable mitten having a plurality of additional pockets for carrying related disposable items on a user's left hand.

Sanitary napkins 70 are larger and of a different shape than other types of sanitary items 40, such as tampons 74. For larger items, such as sanitary napkins 70, the biodegradable, disposable glove is preferably in the shape of a mitten 150, as shown in FIG. 5 and FIG. 7. The biodegradable, disposable mitten 150 has a glove body 60, with a palm portion 61 for receiving adjoining multiple fingers 64, and a separate thumb receiving portion 66. A ziplock type releasable sealing closure 62 is located about the open end 68 of the mitten 150 adjacent to the user's wrist. A somewhat larger first pocket 20 is secured to the palm portion 61 of the mitten 150. A larger second pocket 30 is also secured to the back hand portion of the mitten 150.

This larger, first pocket 20 and second pocket 30 can cover both the palm area 61 of the glove body and a portion of the finger receiving area 64 as well, so it can be considerably larger in size than the first pocket 20 or second pocket 30, previously disclosed. As shown in FIG. 5, the biodegradable, disposable mitten 150, includes a first and second larger sized pocket 20, 30, for receiving a sanitary napkin 70. The first larger pocket 20 and second larger pocket 30 may each have its own pocket closure 72. Prior to use, an unused sanitary napkin 70 may be stored within the larger first pocket 20 or larger second pocket 30, and after use, the used sanitary napkin 70 is placed within one of the larger first pocket 20 or second pocket 30, in preparation for disposal. Where provided, the sanitary napkin 70 may be sealed within the larger first pocket 20 or the larger second pocket 30 with a suitable releasable pocket closure 72. A tampon 74 may alternately be secured within the larger pocket 20, 30.

As previously noted for the disposable glove 100, the disposable mitten 150 is designed to be pulled over the sanitary napkin 70 located within the larger first or second pocket 20, 30, into an inside-out configuration. In the inside-out configuration, the releasable closure 62 is secured about the open end 68 of the mitten 150, to secure the sanitary napkin 70 within the first larger pocket 20 or the second larger pocket 30 of the mitten 150 when placed on either the left hand or the right hand. The combination mitten 150 and sanitary napkin 70 may then be safely disposed of, without danger of spilling fluid or soiling the user's hand. The used sanitary napkin 70 is effectively sealed within the inverted mitten 150, substantially eliminating offensive odors and fluid leaks.

One or more additional pocket(s) 90 may be secured to the disposable glove 100 or to the disposable mitten 150. The multiple pockets 90 are sized to carry other items, such as lotion, medication, suppositories, etc. One pocket may contain an antiseptic cleaning fluid or other cleaning agent, and another pocket may contain a toilette or other cleaning material. Other items can also be provided, as appropriate for differing purposes. The multiple pockets 90 may be located adjacent to, upon, above or below the first pocket 20 and the second pocket 30 to suit manufacturing preference.

At least one Side loop 92 may also be positioned adjacent to the thumb side of the glove body 11 or mitten body 60. An additional side loop 92 may be positioned and secured adjacent to the little finger side of the glove body 11 or mitten body 60. The side loops 92 are preferably sized to receive a sanitary item, such as a tampon 74 therein.

Indicia (not shown) is preferably positioned on the inverted side of the glove, to identify the presence of used sanitary items stored within the inverted glove apparatus, when the glove is turned inside out. The indicia is preferably in the form of color, letters or symbols. The glove body 11 or mitten body 60 is preferably opaque, to hide the contents from view.

Thus, the disposable glove with pockets 20,30 or 90 disclosed herein, provides a sanitary way of storing, using and dispensing with used sanitary items. The pockets on both the palm side and the backhand side enable the user to wear the glove 100 or mitten 150 on either the left hand or the right hand side. Additional pockets 90 for carrying related sanitary equipment are located upon, adjacent to, above or below the first and second pockets 20, 30. One or more side loops 92 are located on the thumb side and/or the little finger side of the disposable glove 100 or mitten 150; and are sized to receive and hold a tampon 74 therein.

The invention being thus described, it will be evident that the same may be varied in many ways. Such variations are not to be regarded as a departure from the spirit and scope of the invention and all such modifications are intended to be included within the scope of the claims.

I claim:

1. A disposable glove apparatus for carrying and disposing of a sanitary item, comprises:

a) a glove body sized to loosely enclose a hand, said glove body having a palm portion and a back hand portion, with adjoining finger portions, and a thumb portion;

b) said glove body further having an open wrist end portion, the open wrist end portion of the glove body having a releasable securement means operable when the glove body is turned inside out;

c) a first pocket positioned on the palm portion, the first pocket sized for receiving the sanitary item therein; and d) a second pocket positioned on the backside of the glove body, the second pocket enabling a user to selectively position one of the first pocket and the second pocket adjacent to the user's palm, when worn on either the left hand or the right hand.

2. The disposable glove apparatus of claim 1, wherein the glove body is made of a biodegradable material, for ease of disposal, without prolonged damage to the environment.

3. The disposable glove apparatus of claim 1, wherein the glove body is similar in shape to a mitten.

4. The disposable glove apparatus of claim 1, wherein the releasable securement means on the open end of the glove body is a zip lock type securement means.

5. The disposable glove apparatus of claim 1, wherein additional pockets are positioned on said palm portion and said backhand portion of the glove, and said additional pockets are sized to receive other sanitary and cleaning items therein.

6. The disposable glove apparatus of claim 1, wherein at least one side loop is provided adjacent to the side of the glove, each side loop sized to receive and hold a tampon therein.

7. The disposable glove apparatus of claim 1, wherein indicia is positioned on the inverted side of the glove, to identify the presence of used sanitary items stored within the inverted glove apparatus, when the glove is turned inside out.

8. The disposable glove apparatus of claim 1, wherein one pocket on the disposable glove contains an antiseptic cleaning fluid.

9. The disposable glove apparatus of claim 1, wherein one pocket on the disposable glove contains a toilette.

10. A disposable glove apparatus for carrying a sanitary item, said disposable glove comprises:

a) a biodegradable, opaque glove body sized to loosely enclose a hand, said glove body having a first palm side and a second back hand side, the glove body with separate finger portions and a thumb portion, the glove body further with an open wrist end;

b) the open wrist end of the biodegradable glove body having a releasable securement means operable when the glove body is turned inside out;

c) a first pocket on the first palm side of the glove, the first pocket sized for receiving a biodegradable sanitary item therein, the first pocket having an opening facing towards the finger portions; and d) a second, pocket positioned upon the backside of the glove, the second pocket sized for receiving a sanitary item therein, the second pocket having an opening facing towards the finger portions; and wherein said glove may be worn on either the left hand or the right hand depending upon the user's preference, thereby eliminating the need for making, using and selling separate left and right hand disposable gloves.

11. The disposable glove apparatus of claim 10, wherein finger portions on the glove body comprise a mitten type multiple finger portion and a thumb portion.

12. The disposable glove apparatus of claim 10, wherein the releasable securement means on the open end of the glove body is a zip lock type securement means.

13. The disposable glove apparatus of claim 10, wherein additional pockets are positioned adjacent to the first and second pockets to store additional sanitary and cleaning items therein.

14. The disposable glove apparatus of claim 10, wherein at least one side loop is provided adjacent to the side of the glove, each side loop sized to receive and hold a tampon therein.

15. The disposable glove apparatus of claim 10, wherein indicia is used to warn that used sanitary items are stored within the sealed, inverted glove apparatus.

16. A biodegradable, disposable glove apparatus for carrying and disposing of a sanitary item, said disposable glove comprises:

a) a biodegradable glove body sized to loosely enclose a hand, said glove body having a first palm side and a second back hand side, said glove body having finger portions and a thumb portion, with an open end of the glove positioned on the end opposite the finger portions, the glove body sized to be worn on either one of the left hand and the right hand;

b) the open end of the biodegradable glove body having a first releasable securement means operable when the glove body is turned inside out;

c) a first pocket located on the palm side of the glove, the first pocket sized for receiving a sanitary item therein, the first pocket having an opening facing towards the finger portions, the opening on the first pocket releasably secured with a second releasable securement means;

d) a second pocket located on the back hand side of the glove, the opening on the second pocket also facing towards the finger portions, the second pocket sized for receiving a sanitary item therein, the opening on the second pocket releasably secured with a third releasable securement means;

e) at least one additional pocket(s) positioned adjacent to the first pocket, and at least one additional pocket(s) positioned adjacent to the second pocket; with the opening on the additional pocket(s) facing towards the finger portions, the additional pocket(s) for carrying cleaning supplies;

f) at least one side loop positioned adjacent to the thumb side of the glove body, each side loop sized to receive a sanitary item, such as a tampon therein; and wherein the used sanitary item is placed in one of the first pocket and the second pocket, and releasably secured therein with the secondary securement means, and the disposable glove is inverted about the user's hand to enclose the sanitary item within the glove body, and the first releasable securement means is secured to provide a secondary seal about the open end of the biodegradable glove body, for ease of handling and disposal.

17. The disposable glove apparatus of claim 16, wherein the glove body comprises a mitten type multiple finger portion and a thumb portion.

18. The disposable glove apparatus of claim 16, wherein multiple pockets are provided upon at least one of the palm portion and the back hand portion of the glove, said multiple pockets positioned with each opening facing the finger portions of the glove, at least one of said multiple pockets sized to receive a sanitary item therein, and at least one other multiple pocket sized to hold at least one cleaning item therein.

19. The disposable glove apparatus of claim 18, wherein one of the multiple pockets on the disposable glove contains a toilette, and another of the multiple pockets contains an antiseptic cleaning fluid.

20. The disposable glove apparatus of claim 18, wherein the releasable securement means on the open end of the glove body is a zip lock type securement means positioned to seal when the glove is inverted.

* * * * *